US008921630B2

(12) United States Patent
Ripperger et al.

(10) Patent No.: US 8,921,630 B2
(45) Date of Patent: Dec. 30, 2014

(54) PROCESS FOR REMOVING SULFUR FROM A FUEL GAS STREAM ADDITIONALLY CONTAINING DIOLEFINS AND OXYGEN

(75) Inventors: Gary Lee Ripperger, Houston, TX (US); Michael Norris Treybig, Houston, TX (US)

(73) Assignee: Shell Oil Company, Houston, TX (US)

( * ) Notice: Subject to any disclaimer, the term of this patent is extended or adjusted under 35 U.S.C. 154(b) by 1437 days.

(21) Appl. No.: 12/192,604

(22) Filed: Aug. 15, 2008

(65) Prior Publication Data

US 2009/0155150 A1 Jun. 18, 2009

Related U.S. Application Data

(60) Provisional application No. 60/956,505, filed on Aug. 17, 2007.

(51) Int. Cl.

| | |
|---|---|
| ***C07C 7/167*** | (2006.01) |
| ***C07C 7/11*** | (2006.01) |
| ***B01D 53/14*** | (2006.01) |
| ***C10L 3/10*** | (2006.01) |

(52) U.S. Cl.
CPC .. *C10L 3/10* (2013.01); *C10L 3/102* (2013.01)
USPC ..... 585/259; 95/235; 585/265; 585/860

(58) Field of Classification Search
USPC ..... 95/235; 585/259, 265, 860
See application file for complete search history.

(56) References Cited

U.S. PATENT DOCUMENTS

| | | | | |
|---|---|---|---|---|
| 2,355,147 | A * | 8/1944 | Chazanow | 423/227 |
| 3,222,410 | A * | 12/1965 | Swanson | 208/57 |
| 3,456,029 | A * | 7/1969 | Inoue et al. | 585/261 |
| 3,755,148 | A * | 8/1973 | Mickelson | 208/143 |
| 4,041,130 | A * | 8/1977 | Mackles | 423/220 |
| 5,135,904 | A * | 8/1992 | Kamiya et al. | 423/622 |
| 7,776,300 | B2 * | 8/2010 | Ripperger | 423/226 |
| 2010/0000911 | A1 * | 1/2010 | Rudolf et al. | 208/254 R |

FOREIGN PATENT DOCUMENTS

| | | | | |
|---|---|---|---|---|
| EP | 0140191 | | 5/1985 | B01D 53/34 |
| JP | 61188492 | A * | 8/1986 | |
| WO | WO9807502 | | 2/1998 | B01D 53/86 |

OTHER PUBLICATIONS

U.S. Appl. No. 12/101,036, filed Apr. 10, 2008.
U.S. Appl. No. 12/126,413, filed May 23, 2008.
Moeller, F. W. et al., "Methanation of Coal Gas for SNG"—"Plant Tests Prove Catalysts and Process Feasibility, Set Design Parameters", Hydrocarbon Processing, vol. 53, 1974, pp. 69-74.

* cited by examiner

*Primary Examiner* — Randy Boyer
(74) *Attorney, Agent, or Firm* — Charles W. Stewart

(57) ABSTRACT

Disclosed is a process for the removal of sulfur from a fuel gas stream that additionally contains diolefins and oxygen as well as organic sulfur compounds by pretreating the fuel gas stream in a pretreatment reactor in order to significantly reduce the amounts of any diolefins and oxygen contained therein prior to the hydrodesulfurization in a hydrotreater reactor wherein organic sulfur compounds are converted to hydrogen sulfide. The hydrogen sulfide formed is removed from the hydrotreated gas stream by use of an absorption treatment method, such as amine treatment, to yield a treated fuel gas stream having a reduced concentration of hydrogen sulfide and an overall sulfur content that is low enough to meet stringent sulfur regulation requirements.

19 Claims, 1 Drawing Sheet

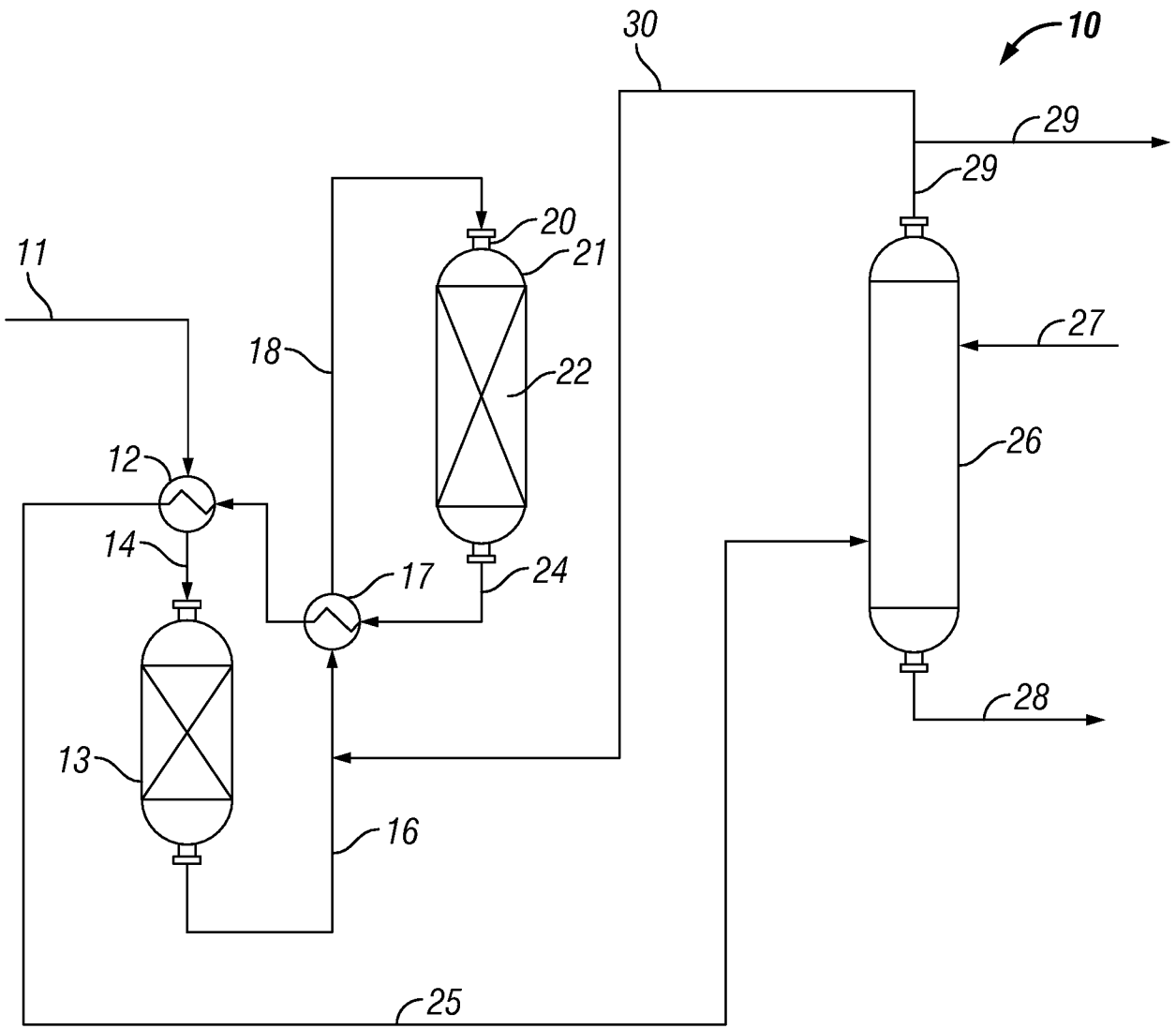
10
29
29
27
26
28
30
20
21
22
24
17
16
25
18
12
14
13
11

PROCESS FOR REMOVING SULFUR FROM A FUEL GAS STREAM ADDITIONALLY CONTAINING DIOLEFINS AND OXYGEN

This application claims the benefit of U.S. Provisional Application No. 60/956,505 filed Aug. 17, 2007, the entire disclosure of which is hereby incorporated by reference.

This invention relates to a process for removing sulfur from a fuel gas stream additionally containing diolefins and oxygen.

There are presently federal regulations that impose certain maximum total sulfur concentration limits on refinery fuel gas streams and there is a trend in certain states and municipalities toward the imposition of even more stringent sulfur requirements for these streams. Among the various approaches that are useful in removing sulfur from refinery fuel gas streams to meet the sulfur regulations, caustic scrubbing and absorption methods are typically used. However, with the significantly lower limits that are being placed on the amount of total sulfur that may be contained within a refinery fuel gas stream, these methods tend to be unsuitable for providing treated refinery fuel gas streams that meet the lower sulfur concentration requirements. Certain of the refinery fuel gas streams such as a coker unit dry gas or a fluid catalytic cracking unit gas can contain concentrations of certain sulfur compounds that are difficult to acceptably be removed there from by traditional caustic or absorption scrubbing and other methods to the lower sulfur concentration levels required by the newer regulations.

One inventive process proposed for use in the removal of sulfur from fuel gas streams that contain organic sulfur and significant concentrations of light olefins is that as described and claimed in U.S. Provisional Application No. 60/911,422, filed 12 Apr. 2007, entitled "A Process for Removing Sulfur From a Fuel Gas Stream," which application is incorporated herein by reference. In this process, highly reactive fuel gas streams that contain significant amounts of light olefin compounds are processed by a catalytic hydrotreating method. The disclosure recognizes the highly exothermic nature of the olefin hydrogenation reaction and notes that it is this attribute of the olefin saturation reaction that causes problems with the hydrotreating of olefin-containing fuel gas streams such as those found in crude oil refinery processes.

The aforementioned provisional application also discloses an inventive process for the hydrotreating of the refinery fuel gas streams that are yielded from the numerous process units of a crude oil refinery. While these refinery fuel gas streams typically contain organic sulfur and olefins, a number of them also contain small concentrations of diolefins and oxygen. The presence of diolefins and oxygen is problematic since diolefins and oxygen can react to form peroxides, which can polymerize, resulting in fouling in the hydrotreater reactor. Diolefins can also react to form polymers that can also cause fouling in the hydrotreater reactor. Additionally, oxygen can also react with hydrogen sulfide to produce water vapor and elemental sulfur. The sulfur that is produced from this reaction can also foul equipment and catalyst in the hydrotreater reactor.

To address the problem associated with the hydrotreating of an organic sulfur compound-containing fuel gas stream that additionally contains diolefins and oxygen, it would be desirable to have a process that effectively removes organic sulfur from such a fuel gas stream with a reduced risk of reactor fouling due to polymer formation or the formation of elemental sulfur. The present invention provides such a process.

Accordingly, provided is a process for removing sulfur from a fuel gas stream that additionally contains diolefins and oxygen as well as organic sulfur compounds, wherein said process comprises: introducing said fuel gas stream into a pretreatment reactor wherein it is contacted with hydrogen in the presence of a catalyst under conditions that the diolefins contained in said fuel gas stream are substantially converted to olefins and the oxygen contained in said fuel gas stream is substantially converted to water vapor; introducing said fuel gas stream reduced in diolefins and oxygen from the pretreatment reactor into a hydrotreater reactor containing a hydrotreating catalyst, wherein said fuel gas stream is contacted under hydrodesulfurization process conditions with hydrogen in the presence of said hydrotreating catalyst, wherein organic sulfur compounds are substantially converted to hydrogen sulfide; and treating said hydrotreated fuel gas to remove hydrogen sulfide therefrom thereby yielding a treated fuel gas stream having a reduced concentration of hydrogen sulfide and organic sulfur compounds. By "substantial conversion" of diolefins to olefins in the pretreatment reactor is meant a conversion of at least 50%, preferably a conversion of at least 70%, and most preferably a conversion of at least 99%. By "substantial conversion" of oxygen to water vapor in the pretreatment reactor is meant a conversion of at least 50%, preferably a conversion of at least 60%, and most preferably a conversion of at least 99%.

FIG. 1 is a process flow schematic that presents one or more embodiments of the inventive process for removing organic sulfur from a fuel gas stream that contains diolefins and oxygen in addition to organic sulfur compound compounds.

The invention relates to the processing of a fuel gas stream that contains concentrations of organic sulfur, diolefins and oxygen, by pretreating the fuel gas stream in a pretreatment reactor in order to significantly reduce the amounts of any diolefins and oxygen that are contained therein prior to the primary hydrotreating reaction which converts organic sulfur to hydrogen sulfide. In the context of a crude oil refinery, hydrotreating is proposed as a means for removing organic sulfur from one or more refinery fuel gas streams followed by the use of an absorption treatment method, such as amine treatment, to thereby remove the hydrogen sulfide from the hydrotreated fuel gas stream to yield a treated fuel gas stream having a reduced concentration of hydrogen sulfide and an overall sulfur content that is low enough to meet many of the more stringent sulfur regulation requirements.

The fuel gas stream of the inventive process, in addition to organic sulfur compounds, will contain a concentration of at least one diolefin and may also contain a concentration of oxygen. As noted earlier herein, the presence of diolefins and oxygen in a fuel gas stream that contains organic sulfur compounds can cause the undesirable formation of polymers which can foul heat exchange equipment and the hydrotreating reactor when the fuel gas stream is hydrotreated by contacting it under hydrodesulfurization process conditions with a hydrotreating catalyst.

The amounts of organic sulfur compounds, diolefins and oxygen present in the fuel gas stream can vary widely depending upon the particular source of the fuel gas. But, typically, the diolefin concentration of the fuel gas stream of the inventive process will be in the range of from 2 ppmv to 2.0 vol %, more typically, in the range of from 5 ppmv to 1.5 vol %, and most typically in the range of from 10 ppmv to 1.0 vol %. Typically, if oxygen is present in the fuel gas stream, it will be present in the range of from 10 ppmv to 5.0 vol %, more typically from 100 ppmv to 3.0 vol %, and most typically from 150 ppmv to 1.5 vol %

The organic sulfur compounds that can be present in the fuel gas stream can include organic sulfur compounds that include thiol compounds, thiophene compounds, disulfide compounds and carbonyl sulfide. The thiol compounds can include one or more of the various aliphatic mercaptans, such as, for example, methyl mercaptan, ethyl mercaptan, propyl mercaptan, butyl mercaptan, and amyl mercaptan, and aromatic mercaptans, such as, for example, phenyl mercaptan. The thiopheneic compounds can include thiophene and any of the benzothiophenes and substituted thiophenes.

The concentration of the mercaptans in the fuel gas stream is generally in the range upwardly to 5000 ppmv (0.5 volume percent of the fuel gas stream). But, for the inventive process, the mercaptan concentration in the fuel gas stream to be treated will, typically, be more than 20 ppmv and in the range of from 20 ppmv to 3000 ppmv. More typically, the mercaptan concentration is in the range of from 40 ppmv to 2000 ppmv, and, most typically, from 45 ppmv to 1500 ppmv.

The organic sulfur compounds that include thiophenes, organic disulfides and carbonyl sulfide are the more difficult compounds to remove from a fuel gas stream by use of conventional sulfur removal methods. The concentration of the these organic sulfur compounds in the fuel gas stream of the inventive process can, collectively, be in the range of from 1 ppmv to 500 ppmv, but, typically, the collective concentration of these organic sulfur compounds will be in the range of from 2 to 300 ppmv, and, more typically, from 3 to 200 ppmv. The specific concentration of the carbonyl sulfide in the fuel gas stream can be upwardly to 500 ppmv, and, more typically, from 1 to 300 ppmv.

The total concentration of all the organic sulfur compounds, including thiol compounds, thiophene compounds, disulfide compounds and carbonyl sulfide, contained in the fuel gas stream of the inventive process is, typically, in the range of from 40 ppmv to 5000 ppmv. More typically, the total concentration of all the organic sulfur compounds contained in the fuel gas stream to be treated is in the range of from 45 ppmv to 3000 ppmv, and, most typically, from 50 ppmv to 2000 ppmv.

The fuel gas stream treated by the inventive process will typically also contain light olefins, the amount of which will vary depending upon the particular source or sources of the fuel gas stream. The concentration of light olefins can range from as low as 0.1 vol %, upwardly to 50 volume percent (%) of the fuel gas stream. For instance, an FCC dry gas will contain significantly higher quantities of light olefins as compared to fuel gas streams from other sources, but, typically, the light olefin concentration of the fuel gas stream of the inventive process will be in the range of from 0.1 vol % to 45 vol %, more typically, from 0.5 vol % to 40 vol %, and, most typically, from 1 vol % to 30 vol %.

The inventive process is particularly useful in the processing of refinery fuel gas streams that are produced from any one or more of the numerous process units of a crude oil refinery. These refinery streams may separately be introduced into the pretreatment reactor and hydrotreater reactor of the inventive process, or they may be combined in any manner and by any means and introduced as one or more combined feeds into the pretreatment reactor and hydrotreater reactor. Typical refinery gas streams that can be feed streams to the pretreatment reactor and hydrotreater reactor of the inventive process are those generated by a delayed coker unit, such as the coker dry gas and coker propylene vapor, a fluid catalytic cracking unit, such as the FCC dry gas, a flare gas recovery system, tank vents, and vapor overheads from crude unit atmospheric and vacuum towers. The gas streams yielded from these process units can have significant concentrations of organic sulfur compounds. The types and concentrations of the organic sulfur compounds are as previously described in detail herein. Many of these refinery gas streams will also have concentrations of diolefins and may have a concentration of oxygen. Among the refinery gas streams believed to have concentrations of diolefins and oxygen include those from such refinery units as a fluid catalytic cracking unit, a delayed coker unit, and vapor and flare gas recovery systems. Typical diolefin compounds found in these streams include propadiene, butadiene and pentadienes.

An additional characteristic of the refinery fuel gas streams is that they can include significant concentration levels of light or lower olefin compounds, such as ethylene, propylene, butenes and pentenes. More typically, the lower olefin compounds contained in the refinery fuel gas streams of the inventive process include those selected from the group consisting of ethylene, propylene, butylenes and any combination thereof. Typical concentration ranges for these light olefins in the refinery gas streams are as previously described herein.

In addition to organic sulfur compounds, diolefins, oxygen and light olefins, the fuel gas streams that can be treated in accordance with the invention may also contain carbon dioxide and carbon monoxide. The presence of carbon dioxide in the fuel gas stream can result in the undesirable formation of carbonyl sulfide (COS) in addition to the hydrogenation conversion of the organic sulfur that is contained in the fuel gas to hydrogen sulfide. This occurs as a result of the equilibrium reaction that takes place within the hydrotreater reactor between hydrogen sulfide and carbon dioxide to yield carbonyl sulfide and water, which reaction is represented as follows: $H_2S+CO_2 \rightleftharpoons COS+H_2O$. The formation of the carbonyl sulfide is undesirable because it is more difficult to remove from gas streams by the use of standard amine treatment methods than is hydrogen sulfide.

Therefore, in one embodiment of the inventive process involving a fuel gas stream additionally containing carbon dioxide and/or carbon monoxide, the fuel gas stream is first subjected to a pretreatment reaction to convert diolefins to olefins and oxygen to water vapor, and is then subjected to hydrodesulfurization in a hydrotreater reactor producing hydrogen sulfide and COS, and the hydrotreated fuel gas stream is subsequently subjected to a hydrolysis or catalytic reduction step in order to reduce the COS concentration in the hydrotreated fuel stream prior to the removal of hydrogen sulfide by amine treatment or other means. A suitable process for the catalytic reduction of COS, including suitable catalysts and process conditions, is described in U.S. Application No. 60/940,211, filed 25 May, 2007, entitled "A Process for Removing Sulfur from a Fuel Gas Stream Additionally Containing Carbon Dioxide and Light Olefins", which application is incorporated herein by reference.

In accordance with the process of the present invention, the fuel gas stream containing diolefins and oxygen as well as organic sulfur compounds is contacted with hydrogen in the presence of a catalyst in a pretreatment reactor under relatively mild conditions, resulting in the conversion of diolefins to olefins and the conversion of oxygen to water vapor.

Any suitable catalyst, including conventional hydrotreating catalysts, capable of converting diolefins to olefins and oxygen to water vapor, can be used in the pretreatment reactor. Typically such catalysts will include one or more active metal components on a support material. The metal component can include a Group VIB metal component or a Group VIII metal component, or both metal components. It is preferred for the catalyst to comprise both a Group VIB metal component and a Group VIII metal component. The catalyst in the pretreatment reactor can also include a promoter such as a phosphorous component.

The Group VIII metal component of the catalyst in the pretreatment reactor is selected from those Group VIII metal or metal compounds that, in combination with the other components of the catalyst composition, suitably provide a catalyst. The Group VIII metal can be selected from the group consisting of nickel, cobalt, palladium and platinum. Preferably, the Group VIII metal is either nickel or cobalt and, most preferably, the Group VIII metal is cobalt.

The Group VIII metal component contained in the catalyst composition can be in the elemental form or in the form of a metal compound, such as, for example, oxides, sulfides and the like. The amount of Group VIII metal in the catalyst composition can be in the range of from about 0.1 to about 6 weight percent elemental metal based on the total weight of the catalyst composition. Preferably, the concentration of Group VIII metal in the catalyst composition is in the range of from 0.3 weight % to 5 weight %, and, most preferably, the concentration is in the range of from 0.4 weight % to 4.5 weight %.

The Group VIB metal component of the catalyst composition is selected from those Group VIB metal or metal compounds that, in combination with the other elements of the catalyst composition, suitably provide a catalyst. The Group VIB metal can be selected from the group consisting of chromium, molybdenum and tungsten. The preferred Group VIB metal is either molybdenum or chromium and, most preferred is molybdenum.

The Group VIB metal component contained in the catalyst composition can be in the elemental form or in the form of a metal compound, such as, for example, oxides, sulfides and the like. The amount of Group VIB metal in the catalyst composition can be in the range of from about 2 to about 25 weight percent elemental metal based on the total weight of the catalyst composition. Preferably, the concentration of Group VIB metal in the catalyst composition is in the range of from 4 weight % to 18 weight %, and, most preferably, the concentration is in the range of from 5 weight % to 16 weight %.

The support material of the hydrotreating catalyst can be any material that suitably provides a support for the metal hydrogenation components of the hydrotreating catalyst including porous refractory oxides. Examples of possible suitable porous refractory oxides include silica, magnesia, silica-titania, zirconia, silica-zirconia, titania, titania-alumina, zirconia-alumina, silica-titania, alumina, silica-alumina, and alumino-silicate. The alumina can be of various forms, such as, alpha alumina, beta alumina, gamma alumina, delta alumina, eta alumina, theta alumina, boehmite, or mixtures thereof. The preferred porous refractory oxide is amorphous alumina. Among the available amorphous aluminas, gamma alumina is most preferred. The porous refractory oxide generally has an average pore diameter in the range of from about 30 Angstroms to about 500 Angstroms, preferably, from 50 Angstroms to 400 Angstroms, and, most preferably, from 60 Angstroms to 300 Angstroms. The total pore volume of the porous refractory oxide, as measured by standard mercury porosimetry methods, is in the range of from about 0.2 cc/gram to about 2 cc/gram. Preferably, the pore volume is in the range of from 0.3 cc/gram to 1.5 cc/gram, and, most preferably, from 0.4 cc/gram to 1 cc/gram. The surface area of the porous refractory oxide, as measured by the B.E.T. method, generally exceeds about 50 $m^2$/gram, and it is typically in the range of from about 100 to about 500 $m^2$/gram.

A preferred catalyst for use in the pretreatment reactor is a catalyst comprising cobalt/molybdenum on an alumina support. A particularly preferred catalyst comprises from 3 to 4 weight % cobalt, 13 to 14 weight % molybdenum on an alumina support having a surface area of approx. 240 $m^2$/gram and a pore volume of approx. 0.53 cc/gram.

The temperature and pressure conditions within the pretreatment reactor are controlled so as to provide suitable conditions for the hydrogenation of diolefins and oxygen contained in the fuel gas stream introduced into the pretreatment reactor. The contacting temperature in the pretreatment rector should be "relatively mild". By "relatively mild" is meant a temperature in the general range of from 150° F. (65.6° C.) to 400° F. (204.4° C.), preferably, from 250° F. (121.1° C.) to 350° F. (176.7° C.), and, most preferably, from 300° F. (148.9° C.) to 350° F. (176.7° C.). As for the contacting pressure in the pretreatment reactor, it should generally in the range of from 30 psig to 1000 psig, preferably, from 50 psig to 400 psig, and, most preferably, from 70 psig to 300 psig. The flow rates at which the fuel gas stream is charged to the pretreatment reactor of the inventive process are generally such as to provide a gaseous hourly space velocity (GHSV) in the range of from 0.01 $hr^{-1}$ to 6000 $hr^{-1}$. The term "gaseous hourly space velocity," as used herein, means the numerical ratio of the rate at which the fuel gas stream, including added hydrogen, if any, that is charged to the pretreatment reactor in volume (at standard temperature and pressure conditions) per hour divided by the volume of hydrotreating catalyst contained in the pretreatment reactor to which the fuel gas stream is charged. The preferred GHSV in the pretreatment reactor is the range of from 0.05 $hr^{-1}$ to 4000 $hr^{-1}$, more preferably, from 100 $hr^{-1}$ to 3500 $hr^{-1}$, and, most preferably, from 500 $hr^{-1}$ to 3200 $hr^{-1}$.

After substantial removal of olefins and oxygen in the pretreatment reactor, the fuel gas stream depleted in diolefins and oxygen is passed to a hydrotreater reactor, which includes a reactor vessel that defines a volume and in which is contained one or more beds of hydrotreating catalyst. The fuel gas stream is introduced into the hydrotreater reactor wherein it is contacted with hydrogen in the presence of a hydrotreating catalyst as hereafter described. The reaction conditions within the reactor vessel are maintained at hydrodesulfurization conditions in order to promote the catalytic conversion of the organic sulfur compounds to hydrogen sulfide. A hydrotreater reactor effluent, or hydrotreated fuel gas, leaving the hydrotreater reactor will have a hydrogen sulfide concentration and may also have a carbonyl sulfide concentration, depending on whether carbon dioxide was present in the feed gas stream to the hydrotreater reactor as discussed above.

Any suitable hydrogenation catalyst, including conventional hydrotreating catalysts that comprise a metal component on a support material, can be used in one or more beds in the hydrotreater reactor. The metal component can include a Group VIB metal component or a Group VIII metal component, or both metal components. It is preferred for the hydrotreating catalyst to comprise both a Group VIB metal component and a Group VIII metal component. The hydrotreating catalyst can also include a promoter such as a phosphorous component.

The Group VIII metal component of the hydrotreating catalyst composition is selected from those Group VIII metal or metal compounds that, in combination with the other components of the catalyst composition, suitably provide a hydrotreating catalyst. The Group VIII metal can be selected from the group consisting of nickel, cobalt, palladium and platinum. Preferably, the Group VIII metal is either nickel or cobalt and, most preferably, the Group VIII metal is cobalt.

The Group VIII metal component contained in the hydrotreating catalyst composition can be in the elemental form or in the form of a metal compound, such as, for example, oxides, sulfides and the like. The amount of Group VIII metal in the hydrotreating catalyst composition can be in the range of from about 0.1 to about 6 weight percent elemental metal based on the total weight of the hydrotreating catalyst composition. Preferably, the concentration of Group VIII metal in the hydrotreating catalyst composition is in the range of from 0.3 weight % to 5 weight %, and, most preferably, the concentration is in the range of from 0.4 weight % to 4.5 weight %.

The Group VIB metal component of the hydrotreating catalyst composition is selected from those Group VIB metal or metal compounds that, in combination with the other elements of the hydrotreating catalyst composition, suitably provide a hydrotreating catalyst. The Group VIB metal can be selected from the group consisting of chromium, molybdenum and tungsten. The preferred Group VIB metal is either molybdenum or chromium and, most preferred, is molybdenum.

The Group VIB metal component contained in the hydrotreating catalyst composition can be in the elemental form or in the form of a metal compound, such as, for example, oxides, sulfides and the like. The amount of Group VIB metal in the hydrotreating catalyst composition can be in the range of from about 2 to about 25 weight percent elemental metal based on the total weight of the hydrotreating catalyst composition. Preferably, the concentration of Group VIB metal in the hydrotreating catalyst composition is in the range of from 6 weight % to 18 weight %, and, most preferably, the concentration is in the range of from 7 weight % to 16 weight %.

The support material of the hydrotreating catalyst can be any material that suitably provides a support for the metal hydrogenation components of the hydrotreating catalyst including porous refractory oxides. Examples of possible suitable porous refractory oxides include silica, magnesia, silica-titania, zirconia, silica-zirconia, titania, titania-alumina, zirconia-alumina, silica-titania, alumina, silica-alumina, and alumino-silicate. The alumina can be of various forms, such as, alpha alumina, beta alumina, gamma alumina, delta alumina, eta alumina, theta alumina, boehmite, or mixtures thereof. The preferred porous refractory oxide is amorphous alumina. Among the available amorphous aluminas, gamma alumina is most preferred.

The porous refractory oxide generally has an average pore diameter in the range of from about 30 Angstroms to about 500 Angstroms, preferably, from 50 Angstroms to 400 Angstroms, and, most preferably, from 60 Angstroms to 300 Angstroms. The total pore volume of the porous refractory oxide, as measured by standard mercury porosimetry methods, is in the range of from about 0.2 cc/gram to about 2 cc/gram. Preferably, the pore volume is in the range of from 0.3 cc/gram to 1.5 cc/gram, and, most preferably, from 0.4 cc/gram to 1 cc/gram. The surface area of the porous refractory oxide, as measured by the B.E.T. method, generally exceeds about 50 $m^2$/gram, and it is typically in the range of from about 100 to about 500 $m^2$/gram.

The temperature and pressure conditions within the hydrotreater reactor vessel are controlled so as to provide suitable hydrodesulfurization reaction conditions for the hydrogenation of the organic sulfur compounds contained in the fuel gas stream introduced into the hydrotreater reactor vessel. The contacting temperature should generally be in the range of from 230° C. (446° F.) to 480° C. (896° F.), preferably, from 255° C. (491° F.) to 450° C. (842° F.), and, most preferably, from 238° C. (460° F.) to 430° C. (806° F.). As for the contacting pressure, it should generally in the range of from 30 psig to 1000 psig, preferably, from 50 psig to 500 psig, and, most preferably, from 70 psig to 400 psig.

The flow rates at which the fuel gas stream is charged to the hydrotreater reactor vessel of the inventive process are generally such as to provide a gaseous hourly space velocity (GHSV) in the range of from 0.01 $hr^{-1}$ to 6000 $hr^{-1}$ The term "gaseous hourly space velocity," as used herein, means the numerical ratio of the rate at which the fuel gas stream, including added hydrogen, if any, that is charged to the hydrotreater reactor vessel in volume (at standard temperature and pressure conditions) per hour divided by the volume of hydrotreating catalyst contained in the hydrotreating reactor vessel to which the fuel gas stream is charged. The preferred GHSV is in the range of from 0.05 $hr^{-1}$ to 4000 $hr^{-1}$, more preferably, from 0.1 $hr^{-1}$ to 3500 $hr^{-1}$, and, most preferably, from 0.2 $hr^{-1}$ to 3200 $hr^{-1}$.

As a result of the hydrodesulfurization reactions of the hydrotreating step, the hydrotreated fuel gas that exits the hydrotreater reactor will have a significantly reduced organic sulfur concentration that is below the organic sulfur concentration of the fuel gas stream that is introduced as a feed to the hydrotreater reactor for hydrodesulfurization. But, the hydrotreated fuel gas will also contain an amount of hydrogen sulfide that needs to be removed therefrom in order to ultimately provide a treated fuel gas stream that has a reduced concentration of hydrogen sulfide that is low enough to comply with regulations regarding sulfur concentration limits for fuel gas streams that are to be combusted. One method for removing the hydrogen sulfide from the hydrotreated fuel gas stream is by use of any suitable method or means of absorption treating that utilizes an amine absorbent.

As discussed above, one problem with the use of amine absorption techniques in the removal of the hydrogen sulfide from the hydrotreated fuel gas of the inventive process is that the hydrotreated fuel gas also can have a concentration of carbonyl sulfide which is difficult to remove by the use of standard amine absorption techniques.

In the embodiment of the present invention involving a hydrolysis or catalytic reduction step, the hydrotreated fuel gas is introduced into a hydrolysis reactor that contains a hydrolysis or reduction catalyst. Within the hydrolysis reactor, the hydrotreated fuel gas is contacted with a reducing compound, under suitable hydrolysis reaction conditions, in the presence of a hydrolysis catalyst. The hydrolysis reaction includes the reaction of carbonyl sulfide with a reducing compound, such as, water, carbon monoxide, and hydrogen, to yield at least hydrogen sulfide. The hydrolysis reactor effluent, thus, contains a reduced concentration of carbonyl sulfide and is yielded from the hydrolysis reactor. Suitable hydrolysis reaction conditions and hydrolysis catalysts are described in U.S. Application No. 60/940,211, mentioned above, and incorporated herein by reference.

Because of the heat released from the hydrogenation reactions within the hydrotreater reactor, the hydrotreated fuel gas stream will have a temperature that is significantly higher than the temperature of the fuel gas stream that is introduced into the hydrotreater reactor at the hydrotreater reactor inlet. As already noted, in those embodiments of the invention having a hydrolysis reactor, it is desirable for the hydrotreated fuel gas stream to be cooled prior to its introduction into the hydrolysis reactor. This cooling can be done by any suitable method or means known to those skilled in the art, but it is preferred to recover a portion of the heat that is released by the hydrogenation reactions in the hydrotreater reactor and contained in the hydrotreated fuel gas stream by exchanging heat energy contained therein with at least a portion of the fuel gas stream that is introduced into the pretreatment reactor and/or hydrotreater reactor. This may be accomplished by the use of a feed/effluent heat exchanger that provides heat exchange means for exchanging heat energy between at least a portion of the fuel gas stream feed into the pretreatment reactor and/or hydrotreater reactor and at least a portion of the hydrotreated fuel gas stream, to thereby provide the hydrotreated fuel gas stream having a desired hydrolysis reactor inlet temperature and a fuel gas stream having a desired pretreatment reactor inlet temperature and/or a desired hydrotreater reactor inlet temperature.

The hydrolysis reactor effluent can further be treated to remove the hydrogen sulfide therefrom by the use of any suitable means or method for reducing the hydrogen sulfide content of the hydrolysis reactor effluent, or portions thereof, so as to provide a treated fuel gas stream having a reduced concentration of hydrogen sulfide that, generally, is less than 100 ppmv. It is, however, desirable to provide a treated fuel gas stream that has a hydrogen sulfide concentration of less than 80 ppmv, and, more desirably, the hydrogen sulfide concentration of the treated fuel gas stream is less than 60 ppmv. It is especially desirable for the treated fuel gas stream to have a hydrogen sulfide concentration of less than 40 ppmv, and, more especially, less than 10 ppmv. This reduced concentration of hydrogen sulfide provides a treated fuel gas that will meet most of the more stringent sulfur regulations and that has a suitably low hydrogen sulfide concentration such that it may be combusted or burned in typical combustion devices or means for combusting or burning treated fuel gas. Examples of such combustion means include the burners that are used in refinery heaters, furnaces, flares, and other equipment.

A preferred method of treating the hydrotreater reactor effluent (or hydrolysis reactor effluent in those embodiments of the invention having a hydrolysis reactor), is to remove the hydrogen sulfide by the use of traditional absorption scrubbing of the gas stream to remove the hydrogen sulfide contained therein. This is done by contacting the hydrotreater reactor effluent or hydrolysis reactor effluent, or a portion thereof, with a suitable absorbent and yielding a treated fuel gas having the reduced concentration of hydrogen sulfide and the absorbent that is rich in hydrogen sulfide. Among the absorption processes that may suitably be used to treat the hydrolysis reactor effluent, amine treating is preferred. Amine treating includes the use of any known amine absorbent, such as, for example, monoethanolamine (MEA), diethanolamine (DEA), methyldiethanolamine (MDEA), diisopropylamine (DIPA), and diglycolamine (DGA).

In one embodiment of the invention, a feature is provided to address certain of the problems associated with the hydrotreating of refinery gas streams that contain high concentrations of light olefins and the high heat release resulting therefrom. It has been determined that either a portion of the treated fuel gas stream (or the hydrolysis reactor effluent in embodiments of the invention having a hydrolysis reactor), can be combined with the refinery gas stream that is charged to the hydrotreater reactor to serve as a diluent to help in the control of the temperature across the hydrotreater reactor. The use of the treated fuel gas stream for recycle or as a diluent is preferable, since this stream will have very little, if any, hydrogen sulfide and carbon dioxide because of their removal by the amine treatment. Use of a stream with little or no hydrogen sulfide or carbon dioxide is preferable, in view of the tendency of these compounds to push the equilibrium reaction toward making carbonyl sulfide.

Reference is now made to the process flow schematic of FIG. 1, which includes for illustrative purposes various embodiments of the inventive process. Depicted in FIG. 1 is a fuel gas treating process 10 for the removal of sulfur from a fuel gas stream that additionally contains diolefins and oxygen as well as organic sulfur compounds. The fuel gas stream containing added hydrogen is passed by way of conduit 11 into a heat exchanger 12. The heat exchanger 12 provides for a heated fuel gas stream that passes from heat exchanger 12 to pretreatment reactor 13 by way of conduit 14. The feed gas stream depleted in diolefins and oxygen leaves the pretreatment reactor via conduit 16 and passes through heat exchanger 17 and conduit 18 and is introduced into hydrotreater reactor 21 through reactor inlet 20. The hydrotreater reactor 21 defines a hydrotreater reactor volume in which is contained a bed of hydrotreating catalyst 22 over which the fuel gas stream is passed and whereby it is contacted with hydrogen under hydrodesulfurization process conditions. A hydrotreated fuel gas that contains hydrogen sulfide is yielded from the hydrotreater reactor 21 as a hydrotreater reactor effluent stream by way of conduit 24.

As a result of the hydrogenation reactions that take place in the hydrotreater reactor 21, the hydrotreated fuel gas has a hydrotreater reactor effluent temperature that is greater than the hydrotreater reactor inlet temperature. One way of recovering this heat of reaction from the hydrotreater effluent is to use the heat exchangers 12 and 17 as feed/effluent exchangers. In this embodiment effluent from the hydrotreater reactor 21 containing hydrogen sulfide and a reduced concentration of organic sulfur compounds passes through heat exchangers 12 and 17 into absorption unit 26 by way of conduits 24 and 25. The absorption unit 26 provides for the removal of hydrogen sulfide that is contained in the hydrotreater reactor effluent by contacting it with a suitable absorbent fluid. A lean absorbent fluid is introduced to the absorption unit 26 through conduit 27 and a rich absorbent fluid containing hydrogen sulfide that is removed from the hydrotreater reactor effluent passes from absorption unit 26 by way of conduit 28. A treated fuel gas having a significantly reduced concentration of hydrogen sulfide passes from the absorption unit 26 by way of conduit 29 to any suitable combustion device or means (not shown) for burning or combusting the treated fuel gas, such as, for example, burners that are used in refinery heaters, furnaces, flares and other equipment.

In cases of fuel gas streams additionally containing carbon dioxide and/or carbon monoxide, the effluent from the hydrotreater reactor may in addition to hydrogen sulfide also contain carbonyl sulfide. In this embodiment, the effluent from the hydrotreater reactor would be passed into a hydrolysis reactor (not shown) to catalytically reduce the carbon disulfide, prior to being introduced into absorption unit 26.

Various recycle streams may be used to control and improve upon the hydrodesulfurization conditions within the hydrotreater reactor 21. For example, a portion of the treated fuel gas stream may be recycled and used as either a diluent to be combined with the fuel gas stream that is charged to the hydrotreater reactor 21 or as a quench stream that is introduced directly into the hydrotreater reactor 21. FIG. 1 shows a portion of the treated fuel gas stream exiting absorption unit through conduit 29 passing by way of conduit 30 to be combined with the fuel gas stream entering hydrotreater reactor 21 via conduits 16 and 18.

In embodiments having a hydrolysis reactor, the effluent from the hydrolysis reactor can also be used for recycle or as a diluent. However, because the treated fuel gas stream has had a significant portion of the hydrogen sulfide and carbon dioxide removed therefrom by the absorption unit 26, it is preferred to use the treated fuel gas stream as a recycle stream or as a diluent.

That which is claimed is:

1. A process for removing sulfur from a refinery fuel gas stream that additionally contains from 2 ppmv to 2.0 vol % diolefins and from 10 ppmv to 5.0 vol % oxygen as well as organic sulfur compounds, wherein said process comprises:

introducing said fuel gas stream into a pretreatment reactor wherein it is contacted with hydrogen in the presence of a catalyst comprising a Group VIB metal and a Group VIII metal selected from the group consisting of cobalt and nickel, on a porous refractory oxide support under mild hydrotreating conditions including a temperature in the range of from 150 ° F. to 350° F., a pressure in the range of from 50 to 400 psig and a gaseous hourly space velocity in the range of from 0.05 $hr^{-1}$ to 4000 $hr^{-1}$, whereby the diolefins contained in said fuel gas stream are substantially converted to olefins and the oxygen contained in said fuel gas stream is substantially converted to water vapor;

introducing said fuel gas stream depleted in diolefins and oxygen into a hydrotreater reactor wherein said fuel gas stream is contacted with hydrogen in the presence of a hydrotreating catalyst under hydrodesulfurization process conditions, including a hydrotreater reactor inlet temperature that is greater than the pretreatment reactor inlet temperature, yielding from said hydrotreater reactor a hydrotreated fuel gas containing hydrogen sulfide; and treating said hydrotreated fuel gas with an amine absorbent to remove hydrogen sulfide therefrom, thereby yielding a treated fuel gas stream having a reduced concentration of hydrogen sulfide and organic sulfur compounds.

2. The process of claim 1, wherein the catalyst used in the pretreatment reactor comprises from 0.3 to 5 weight % of said Group VIII metal and from 4 to 18 weight % of a Group VIB metal.

3. The process of claim 1, wherein the gaseous hourly space velocity in the pretreatment reactor is in the range of from 100 $hr^{-1}$ to 3500 $hr^{-1}$.

4. The process of claim 1, wherein the hydrogen sulfide is removed from the hydrotreated fuel gas by utilizing an amine absorbent selected form the group consisting of monoethanolamine, diethanolamine, methyldiethanolamine, diisopropylamine and diglycolamine.

5. The process of claim 4, wherein the hydrogen sulfide concentration in said treated fuel gas is less than 100 ppmv.

6. The process of claim 2, wherein the Group VIII metal is cobalt and the Group VIB metal is molybdenum.

7. The process of claim 1, wherein the temperature in the pretreatment reactor is in the range of from 250° F. to 350° F. and the pressure in the pretreatment reactor is in the range 70 psig to 300 psig.

8. The process of claim 1, wherein the hydrogen sulfide concentration in said treated fuel gas is less than 60 ppmv.

9. The process of claim 1, wherein a portion of said treated fuel gas is recycled and combined with the fuel gas stream entering said hydrotreater reactor.

10. The process of claim 1, wherein the hydrogen sulfide concentration in said treated fuel gas is less than 40 ppmv.

11. The process of claim 1, wherein said fuel gas stream additionally contains carbon dioxide and carbon monoxide, and wherein said hydrotreated fuel gas containing hydrogen sulfide and carbon disulfide is introduced into a hydrolysis reactor containing a hydrolysis catalyst to reduce the carbonyl sulfide concentration in the hydrotreated fuel gas prior to treatment with an amine absorbent to remove hydrogen sulfide.

12. The process of claim 7, wherein the gaseous hourly space velocity in the pretreatment reactor is in the range of from 500 $hr^{-1}$ to 3200 $hr^{-1}$.

13. The process of claim 1 wherein the hydrogen sulfide concentration in said treated fuel gas is less than 10 ppmv.

14. The process of claim 2, wherein the catalyst in the pretreatment reactor comprises 0.4 to 4.5 weight % cobalt and 5 to 16 weight % molybdenum on an alumina support.

15. The process of claim 1, wherein a portion of the heat that is released by the hydrogenation reactions in the hydrotreater reactor is recovered by exchanging the heat energy contained the hydrotreater reactor effluent with at least a portion of the fuel gas stream that is introduced into the pretreatment reactor or the hydrotreater reactor.

16. The process of claim 12, wherein the catalyst in the pretreatment reactor comprises 3 to 4 weight % cobalt and 13 to 14 weight % molybdenum on an alumina support.

17. The process of claim 1, wherein at least 70% of the diolefins in said fuel gas stream are converted to olefins and at least 60% of the oxygen in said fuel gas stream is converted to water vapor.

18. The process of claim 1, wherein the fuel gas stream comprises from 5 ppmv to 1.5 vol % diolefins and from 100 ppmv to 3.0 vol % oxygen.

19. The process of claim 2, wherein the catalyst used in the pretreatment reactor additionally comprises phosphorus.

* * * * *